US010746383B1

(12) United States Patent
Lan et al.

(10) Patent No.: US 10,746,383 B1
(45) Date of Patent: Aug. 18, 2020

(54) MULTI-ANGLE LIGHT SOURCE DEVICE

(71) Applicant: Shenzhen Guanke Technologies Co., Ltd, Shenzhen (CN)

(72) Inventors: Qing Lan, Shenzhen (CN); Xuren Qiu, Shenzhen (CN); Ligen Liu, Shenzhen (CN); Shoubao Chen, Shenzhen (CN)

(73) Assignee: Shenzhen Guanke Technologies Co., Ltd, Shenzhen (CN)

( * ) Notice: Subject to any disclaimer, the term of this patent is extended or adjusted under 35 U.S.C. 154(b) by 0 days.

(21) Appl. No.: 16/374,859

(22) Filed: Apr. 4, 2019

(30) Foreign Application Priority Data

Jan. 25, 2019 (CN) ..... 2019 2 0142832 U

(51) Int. Cl.

| | |
|---|---|
| ***F21V 21/30*** | (2006.01) |
| ***F21V 29/76*** | (2015.01) |
| *F21Y 105/12* | (2016.01) |
| *F21Y 115/10* | (2016.01) |

(52) U.S. Cl.
CPC ..... *F21V 21/30* (2013.01); *F21V 29/763* (2015.01); *F21Y 2105/12* (2016.08); *F21Y 2115/10* (2016.08)

(58) Field of Classification Search
CPC ..... F21V 21/14; F21V 21/28; F21V 21/30
See application file for complete search history.

(56) References Cited

U.S. PATENT DOCUMENTS

| | | | | |
|---|---|---|---|---|
| 9,039,254 | B2 * | 5/2015 | Danesh | F21V 21/30 362/364 |
| 2008/0080190 | A1 * | 4/2008 | Walczak | F21V 14/02 362/294 |
| 2015/0214194 | A1 * | 7/2015 | Yan | H01L 33/64 257/88 |
| 2015/0345762 | A1 * | 12/2015 | Creasman | F21S 8/038 362/428 |

* cited by examiner

*Primary Examiner* — Julie A Bannan
(74) *Attorney, Agent, or Firm* — Maier & Maier, PLLC

(57) ABSTRACT

A multi-angle light source device includes a holder, a housing movably connected with the holder and rotated relative to the holder, a power supply received in the housing and electrically connected to the holder, and a body fixedly connected to the housing. The body includes a fixing portion fixedly connected to the housing, a connecting portion rotated relative to the fixing portion and at least one illuminant formed on a distal portion of the connecting portion to rotate relative to the connecting portion. The present structure can flexibly adjust its luminous angle so that it can be conveniently used in different lamp-housings, suppress light pollution, reduce waste of electric energy, and further improve its heat dissipation performance of the product by the power supply separating from its heat source of each illuminant.

11 Claims, 9 Drawing Sheets

MULTI-ANGLE LIGHT SOURCE DEVICE

FIELD

The present disclosure generally relates to light source devices field, and especially relates to a multi-angle light source device.

BACKGROUND

An electronic light source is a kind of apparatus or device converted electric energy into light energy. Conventional electronic light sources include bulb-lamps, candle-lamps, corn-lamps, lamp-cups, cross-inserting lamps, fluorescent lamps and the like. A conventional LED electronic light source usually emits light by using a holder such as E26, E27, E39, E40, B22, G24 and other traditional holders. Its assembly and replacement of such electronic light sources can be realized by combining them with a lamp holder fixed with a housing of the lamp. A corresponding light emitting mode of different lamp housings is different which can include a plurality of directions such as downward, obliquely downward, left and right, front and rear, obliquely upward, one-side and upward directions. In order to obtain the light emitting modes mentioned above, a full-angle electronic light source can be selected. However, extra light can be generated by its non-illuminated angle or area of the electronic light source, resulting in light pollution and waste of electric energy.

A conventional LED lotus lamp is disclosed in CN patent NO. 2017218980605 that its emitting light direction can be adjusted by rotating a plurality of light modules uniformly arranged around a lamp body. However, both the number of the light modules and the range of the adjustable angles can limit the compatibility of such product with different complex lamp housings, and it is also failed to prevent light pollution.

SUMMARY

The technical problems to be solved: in view of the shortcomings of the related art, the present disclosure relates to a multi-angle light source device which can flexibly adjust its luminous angle, suppress light pollution and reduce waste of electric energy.

A technical solution adopted for solving technical problems of the present disclosure is:

A multi-angle light source device includes a holder, a housing, a power supply received in the housing and electrically connected to the holder and a body fixedly connected to the housing. The body includes a fixing portion fixedly connected to the housing, a connecting portion rotated relative to the fixing portion and at least one illuminant formed on a distal portion of the connecting portion to rotate relative to the connecting portion.

In some embodiments, the holder is movably connected with the housing and rotated relative to the housing.

In some embodiments the fixing portion includes a pair of holding portions formed on two opposite sides thereof for providing a rotational space for the at least one illuminant.

In some embodiments the fixing portion further includes an internal-hollow connecting end, an inserting end inserted into the connecting end, and a cover fixedly connected to the connecting end to cover on an end portion of the connecting end far away from the inserting end.

In some embodiments the cover includes an expansion control interface electrically connected to the power supply for connecting external control signals of the lamp to externally supply power.

In some embodiments the connecting portion includes a sleeve and an internal-hollow axis sleeved on the sleeve and rotated relative to the sleeve.

In some embodiments the connecting end includes a fixing groove, and the axis includes a fixing member formed on its distal end for engaging with the fixing groove.

In some embodiments the connecting portion further includes an installing portion including a rotating member rotated around it and fixedly connected to the illuminant.

In some embodiments the housing includes a sealing plate, a first block arranged on the inner wall thereof, and a spring perpendicularly fixed with the sealing plate and including a rib protruding outward from the outer wall of the spring; while the holder includes a second block and an internal gear formed inside the holder, the spring plate inserted into the holder so that the rib is embedded in the internal gear, and the holder is stopped rotating relative to the housing when the second block is resisted against the first block.

In some embodiments the multi-angle light source device further includes an installing base for receiving the holder therein.

The structure of the present disclosure can flexibly adjust its luminous angle of the lamp, so as to meet the need for emitting light towards a plurality of angles such as downward, obliquely downward, left and right, front and rear, obliquely upward, one-sided and upward directions, thereby it can be conveniently used in different lamp-housings, and a same lamp can be used in different lighting applications to achieve one purpose of a lamp multipurpose, and further suppress light pollution, reduce waste of electric energy and improve its heat dissipation performance of the product by the power supply separating from the heat source of each illuminant.

BRIEF DESCRIPTION OF THE DRAWINGS

Many aspects of the embodiments can be better understood with reference to the following drawings. The components in the drawings are not necessarily dawns to scale, the emphasis instead being placed upon clearly illustrating the principles of the embodiments. Moreover, in the drawings, like reference numerals designate corresponding parts throughout the several views.

DETAILED DESCRIPTION

Figure 1:
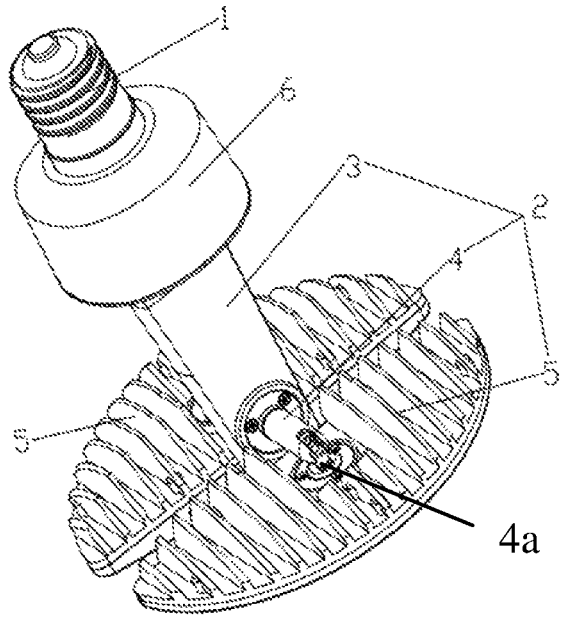
FIG. 1 is a schematic view of the multi-angle light source device in accordance with an exemplary embodiment.
Figure 2:
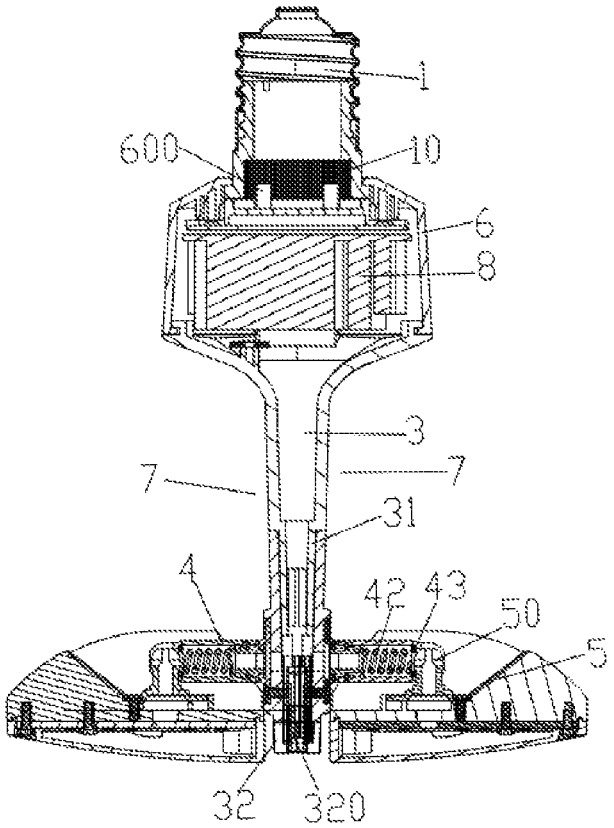
FIG. 2 is a cross-sectional view of the multi-angle light source device of FIG. 1.
Figure 3:
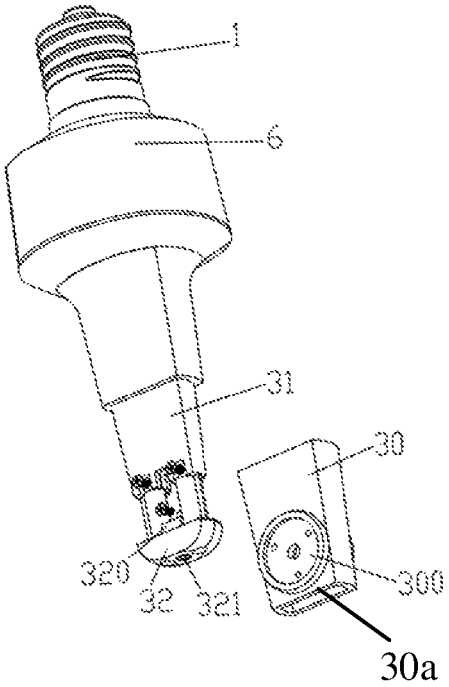
FIG. 3 is a schematic view of a holder, a housing and a fixing portion of the multi-angle light source device of FIG. 1.
Figure 4:
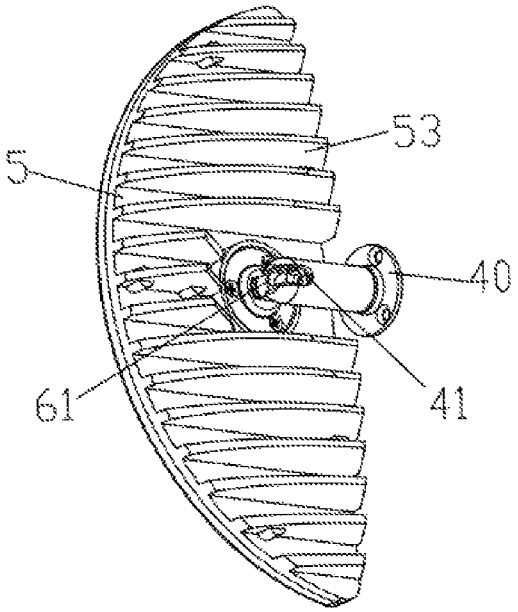
FIG. 4 is an assembly schematic view of a cooling fin, a fixing member, an installing portion and a first block of the multi-angle light source device of FIG. 1.
Figure 5:
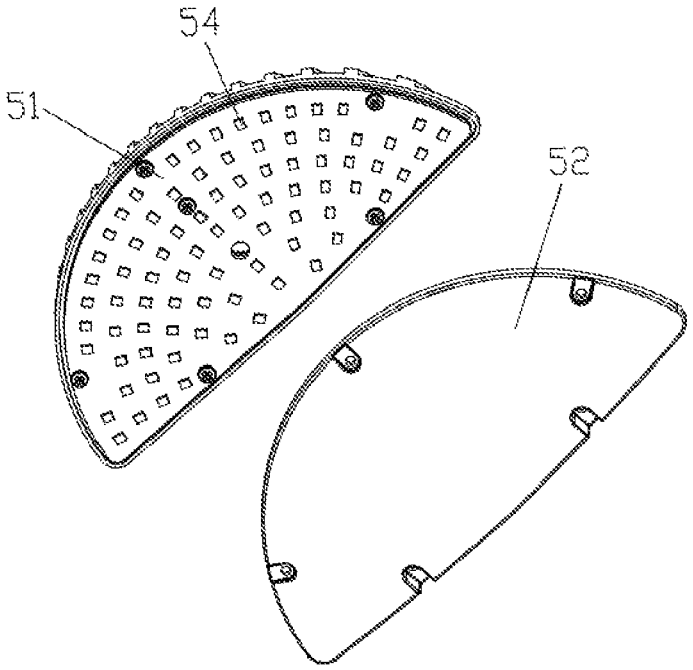
FIG. 5 is a schematic view of an illuminant of the multi-angle light source device of FIG. 1.
Figure 6:
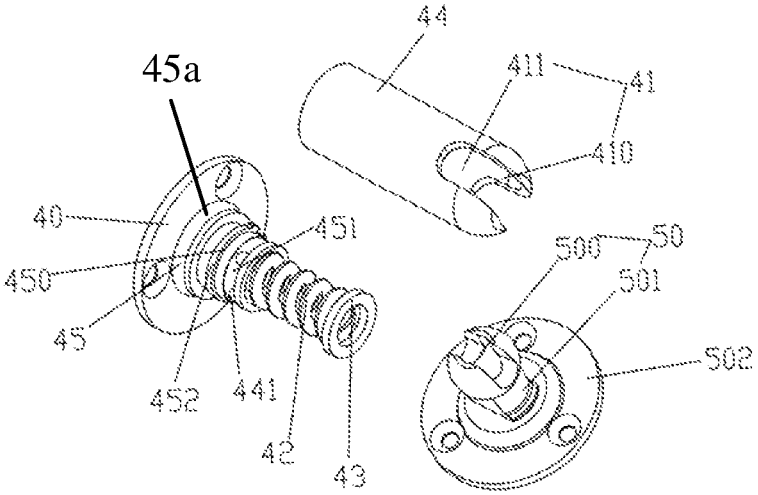
FIG. 6 is a schematic view of a fixing member, an installing portion and a rotating member of the multi-angle light source device of FIG. 1.
Figure 7:
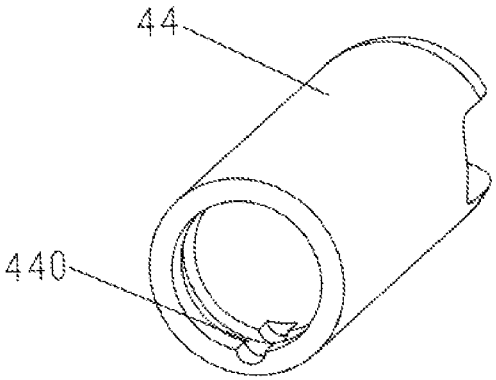
FIG. 7 is a schematic view of a sleeve of the multi-angle light source device of FIG. 1.
Figure 8:
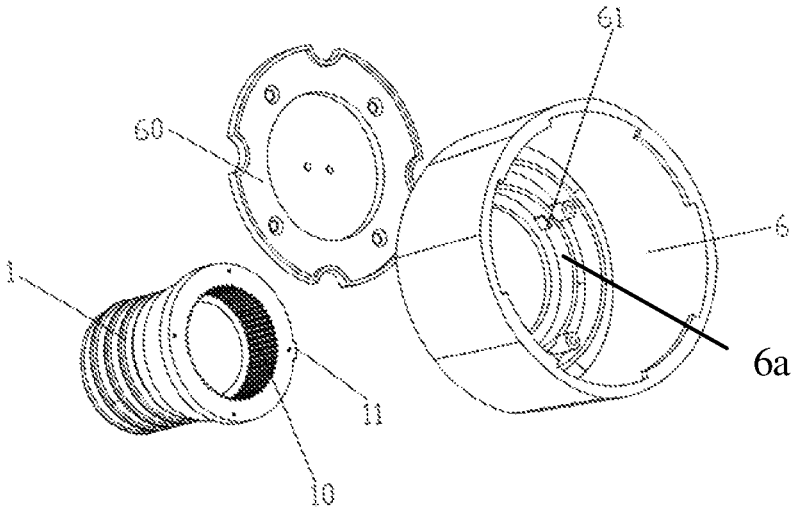
FIG. 8 is an exploded, schematic view of a holder and a housing of the multi-angle light source device of FIG. 1.
Figure 9:
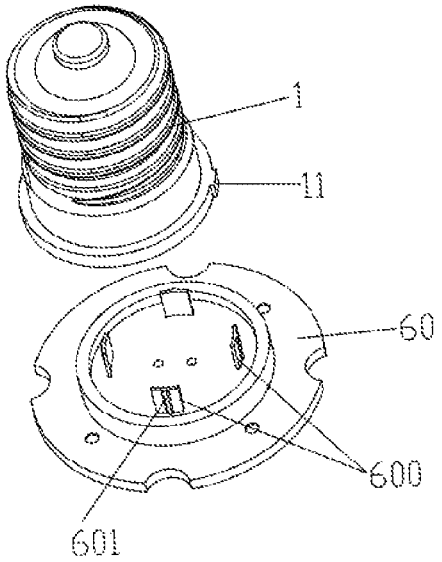
FIG. 9 is an exploded, schematic view of the holder and a sealing plate of the multi-angle light source device of FIG. 1.

The disclosure is illustrated by way of example and not by way of limitation in the figures of the accompanying drawings, in which like reference numerals indicate similar elements.

Referring generally to FIGS. 1-9, the multi-angle light source device in accordance with an exemplary embodiment of the present disclosure includes a holder 1, a housing 6, a power supply 8 electrically connected to the holder 1, and a body 2 fixedly connected to the housing 6. The body 2 includes a fixing portion 3, a connecting portion 4 rotated relative to the fixing portion 3 and at least one illuminant 5 formed on a distal portion 4*a* of the connecting portion 4 to rotate relative to the connecting portion 4.

Furthermore, the holder 1 is movably connected with the housing 6 and rotated relative to the housing 6.

Furthermore, the connecting portion 4 further includes an installing portion 41, the installing portion 41 includes a rotating member 50 rotated around it and fixedly connected to the illuminant 5.

In an exemplary embodiment of the present disclosure, the power supply 8 is received in the housing 6. In other exemplary embodiments of the present disclosure, the power supply 8 can be also arranged in other positions within the lamp or outside the lamp, which are within the protection scope of the present disclosure.

In an exemplary embodiment of the present disclosure, the rotating member 50 includes a head 500, a middle portion 501 connected to the head 500 and a mounting plate 502 connected to a distal end of the middle portion 501. The mounting plate 502 is fixed on the back of the illuminant 5 with screws so that the rotating member 50 is perpendicular to an illuminant surface of the illuminant 5. The installing portion 41 includes a receiving portion 410 for receiving the head 500 therein and a slot 411 connected to the receiving portion 410. The middle portion 501 can pass through the slot 411 and then slide in the slot 411 when the head 500 is rotated in the receiving portion 410.

Specifically, the rotating member 50 (rotating shaft) is taken as the X-axis, the illuminant 5 can rotate on the X-axis when it is rotated relative to the connecting portion 4. The connecting portion 4 (rotating shaft) is taken as the Y-axis, the illuminant 5 can rotate on the Y-axis when the connecting portion 4 is rotated relative to the fixing portion 3. The holder 1 (rotating shaft) is taken as the Z-axis, the illuminant 5 can rotate on the Z-axis when the holder 1 is rotated relative to the housing 6. In this way, the X-axis, the Y-axis and the Z-axis cooperatively form a three-dimensional coordinate system so that the illuminant 5 can optionally adjust its position in the three-dimensional space. In other words, the purpose of flexibly adjusting its luminous angle of the multi-angle light source device can be obtained. Of course, the X-axis, the Y-axis and the Z-axis introduced here are only to explain how to adjust the luminous angle of the illuminant 5. In other exemplary embodiments, if redefining the X-axis, the Y-axis and the Z-axis, it can also achieve that the illuminant 5 for adjusting its luminous angle modes with the same effect as the present disclosure, which are all within the protection scope of the present disclosure.

In an exemplary embodiment of the present disclosure, the angle of the illuminant 5 rotation relative to the connecting portion 4, the angle of the connecting portion 4 rotation relative to the fixing portion 3, and the angle of the holder 1 rotation relative to the housing 6 can all be adjusted according to the actual situation, rather than being limited their three angles.

In an exemplary embodiment of the present disclosure, there is a pair of connecting portions 4 is respectively arranged on two opposite ends of the fixing portion 3; correspondingly, there is also a pair of illuminants 5. The rotation of the pair of illuminants 5 relative to its corresponding connecting portions 4 can be independent of each other, rather than affecting each other. At the same time, the rotation of the pair of connecting portions 4 relative to the corresponding fixing portions 3 are also independent of each other rather than affecting each other. Of course, in other exemplary embodiments of the present disclosure, it is also within the protection scope of the present disclosure to design the number of the connecting portion 4 and the illuminant 5 into other quantities, based on the design features of the present disclosure.

In an exemplary embodiment of the present disclosure, the illuminant 5 is semicircular, and the pair of illuminants 5 cooperatively forms a circular illuminant surface.

Furthermore, the illuminant 5 includes a lamp plate 51, a lampshade 52 for sealing and protecting the lamp plate 51, and a heat sink arranged on the back of the illuminant 5. The heat sink includes a number of cooling fins 53 for heat dissipation of the lamp plate 51, and the lamp plate 51 includes a number of LEDs 54 arranged thereon in a matrix.

In an exemplary embodiment of the present disclosure, the lamp plate 51 is arranged on the front of the illuminant 5, and the plurality of cooling fins 53 is arranged on the back of the illuminant 5. In this way, when adjusting the luminous angle of the illuminant 5, the lamp plate 51 is rotated toward a desired side, and the cooling fin 53 is rotated to face away from the desired side, thereby achieving the effect of suppressing light pollution and reducing the waste of electric energy.

Furthermore, the fixing portion 3 is fixedly connected to the housing 6 and includes a pair of holding portions 7 formed on two opposite sides thereof for providing a rotational space for the at least one illuminant 5.

In an exemplary embodiment of the present disclosure, the pair of holding portions 7 is arranged to provide enough rotational space for the illuminant 5 so that its rotation angle of the illuminant 5 can't be limited by the housing 6 and the fixing portion 3.

In an exemplary embodiment of the present disclosure, the power supply 8 is configured to control a plurality of operating modes of the illuminant 5, such as providing a corresponding current, voltage, or controlling its activation and extinction for the illuminant 5. Furthermore, the power supply 8 is independently designed and a power supply module composed of the power supply 8 and the housing 6 is separated from the illuminant 5, which can improve the heat dissipation performance of the product and realize the application of higher power products.

Furthermore, the fixing portion 3 further includes a connecting end 30, an inserting end 31 inserted into the connecting end 30, and a cover 32 fixedly connected to the connecting end 31 to cover on an end portion 30*a* of the connecting end 30 far away from the inserting end 31.

In an exemplary embodiment of the present disclosure, the connecting end 30 is an internal-hollow configuration. The cover 32 is fixed on the inserting end 31 and cover on the end portion 30*a* of the connecting end 30 with screws so that the connecting end 30 can't be separated from the inserting end 31, which is easy to operate and fixed firmly.

In an exemplary embodiment of the present disclosure, both the inserting end 31 and the cover 32 are made of a plastic material or combination of plastic materials, and the connecting end 30 is made of a metal material or combination of metal materials, which can improve the mechanical strength of the product, as well as the manufacturing efficiency and assembly speed of various parts.

Furthermore, the cover 32 includes an expansion control interface 320 electrically connected to the power supply 8 for connecting external control signals of the lamp to externally supply power or connecting other functional modules.

In an exemplary embodiment of the present disclosure, the expansion control interface 320 includes a plug-in interface 321 for connecting external control members. The expansion control interface 320 can receive or connect external control signals (such as infrared control signals, etc.) of the lamp. In this way, the illuminant 5 can be further effectively controlled by the expansion control interface 320, such as adjusting the brightness of the illuminant 5 and opening or closing the illuminant 5.

Furthermore, the connecting portion 4 includes a sleeve 44 and an internal-hollow axis 45 sleeved on the sleeve 44 and rotated relative to the sleeve 44.

Specifically, the axis 45 further includes a first sliding groove 450, a second sliding groove 451 and a snap spring 452 sleeved around the first sliding groove 450. The sleeve 44 includes a limiting recess 440 for positioning the snap spring 452 thereon. When the axis 45 is rotated relative to the sleeve 44, the snap spring 452 can prevent the sleeve 44 from disengaging from the axis 45 so that the sleeve 44 can only axially rotate rather than axially move. A ball 441 is formed between the sleeve 44 and the axis 45 and can slide in the second sliding groove 451. The second sliding groove 451 is an eccentric-groove configuration to limit a rotation angle of the sleeve 44 relative to the axis 45.

Furthermore, the connecting end 30 includes a fixing groove 300, and the axis 45 includes a fixing member 40 formed on its distal end 45*a* for engaging with the fixing groove 300.

In an exemplary embodiment of the present disclosure, the axis 45 and the connecting end 30 can be tightly fixed together by the fixing member 40, thereby not only the sleeve 44 can rotate relative to the axis 45, but also the connecting portion 4 and the illuminant 5 can be supported reliably.

Furthermore, the axis 45 includes an elastic element 42, and a blocking portion 43 connected to the elastic element 42 and in contact with the rotating member 50.

In an exemplary embodiment of the present disclosure, the axis 45 is an internal-hollow configuration for receiving the elastic element 42 therein. The elastic element 42 is a spring and the blocking portion 43 is a gasket. When the rotating member 50 is rotated in the installing portion 41, the elastic element 42 is compressed so that the rotating member 50, the sleeve 44 and the axis 45 are all damped during their rotations without needing for external adjustment. Thus, it is convenient to adjust the luminous angle when the lamp is used, and the wires between the power supply 8 and the illuminant 5 can be protected by the elastic element 42.

Furthermore, the housing 6 includes a sealing plate 60, a first block 61 arranged on the inner wall 6*a* of the housing 6, and a spring 600 perpendicularly fixed with the sealing plate 60 and including a rib 601 protruding outward from the outer wall of the spring 600. While, the holder 1 includes a second block 11 and an internal gear 10 formed inside the holder 1. The spring plate 60 is inserted into the holder 1 so that the rib 601 is embedded in the internal gear 10, and the holder 1 is stopped rotating relative to the housing 6 when the second block 11 is resisted against the first block 61.

In an exemplary embodiment of the present disclosure, the first block 61 is arranged on the inner wall 6*a* of the housing 6, and the rib 601 is a long strip structure with a semi-circular section. The holder 1 is sleeved around the housing 6 so that the spring plate 60 is inserted into the holder 1 and the rib 601 is embedded in the internal gear 10. There is a number of springs 600 to form a circle there between and a corresponding number of ribs 601 is arranged. When the holder 1 rotating relative to the housing 6, the rib 601 is slid on the internal gear 10 to produce a damping effect there between. While, the holder 1 is stopped rotating relative to the housing 6 when the second block 11 is resisted against the first block 61. The first block 61 and the second block 11 cooperate together to function as a limit member.

In an exemplary embodiment of the present disclosure, the illuminant 5 is rotated relative to the connecting portion 4, the connecting portion 4 is rotated relative to the fixing portion 3, and the holder 1 is rotated relative to the housing 6 so that they are all damped during their rotations, thereby the luminous angle can be conveniently adjusted during using the lamp.

The adjustment effect of the luminous angle of the multi-angle light source device according to the present disclosure is further described below:

Referring to FIG. 1, the figure shows light emitted toward the downward direction.

Figure 10:
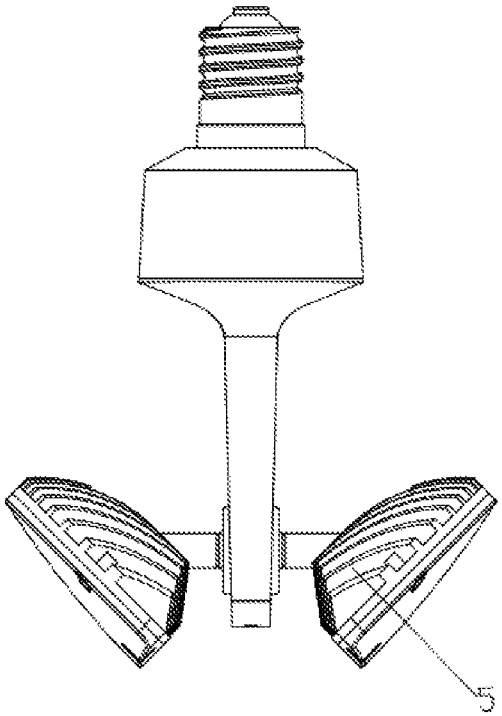
FIG. 10 is a schematic view of the multi-angle light source device of FIG. 1, shown light emitted toward the obliquely downward direction.

Referring to FIG. 10, the figure shows light emitted toward the obliquely downward direction.

Figure 11:
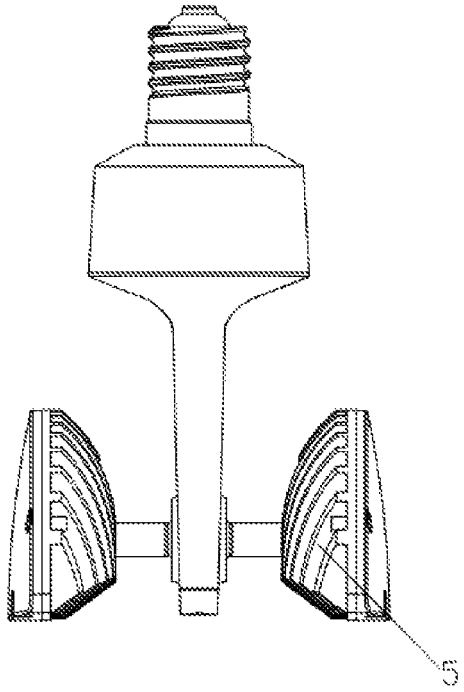
FIG. 11 is similar to FIG. 10, but shown light emitted toward the laterally left and right direction.

Referring to FIG. 11, the figure shows light emitted toward laterally left and right directions.

Figure 12:
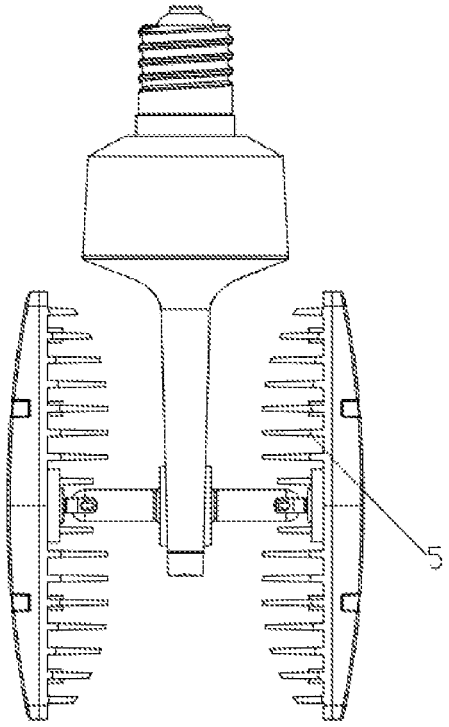
FIG. 12 is similar to FIG. 10, but shown light emitted toward the vertically left and right direction.

Referring to FIG. 12, the figure shows light emitted toward vertically left and right directions.

Figure 13:
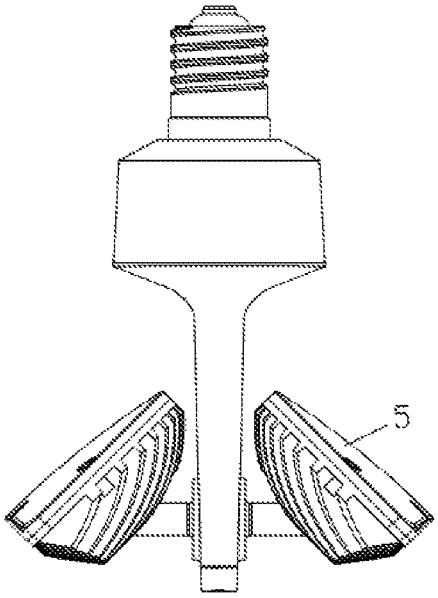
FIG. 13 is similar to FIG. 10, but shown light emitted toward the obliquely left and right and upward direction.

Referring to FIG. 13, the figure shows light emitted toward obliquely left and right and upward directions.

Figure 14:
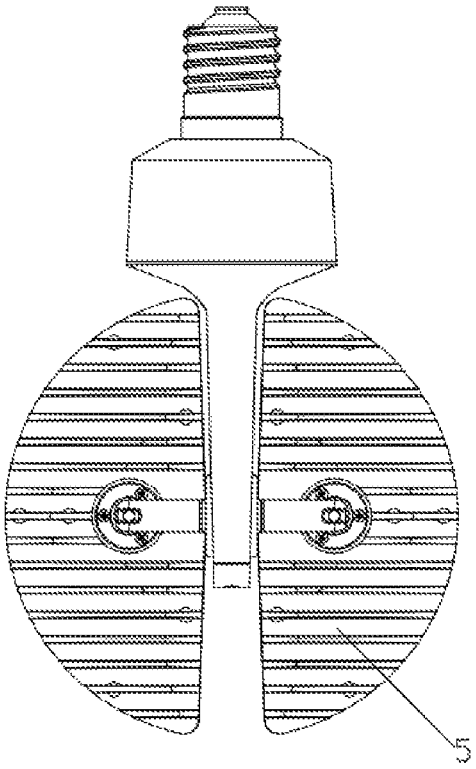
FIG. 14 is similar to FIG. 10, but shown light emitted toward the one-side right under direction.

Referring to FIG. 14, the figure shows light emitted toward the one-side right under direction.

Figure 15:
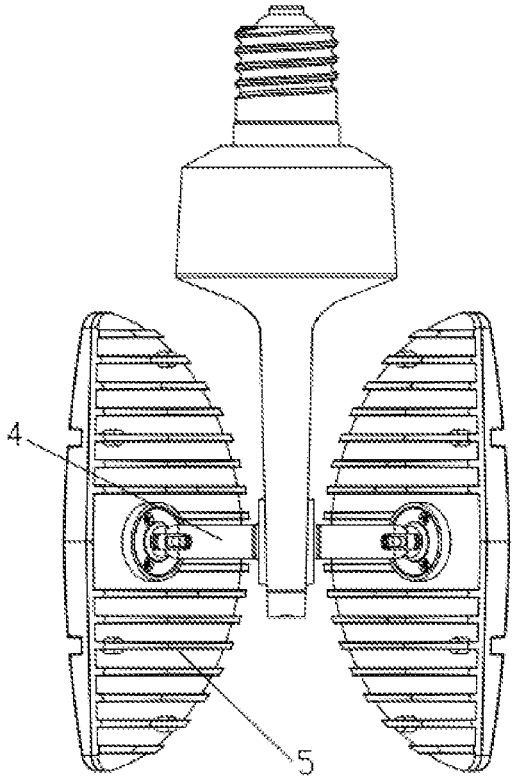
FIG. 15 is similar to FIG. 10, but shown light emitted toward the one-side downward direction.

Referring to FIG. 15, the figure shows light emitted toward the one-side downward direction.

Figure 16:
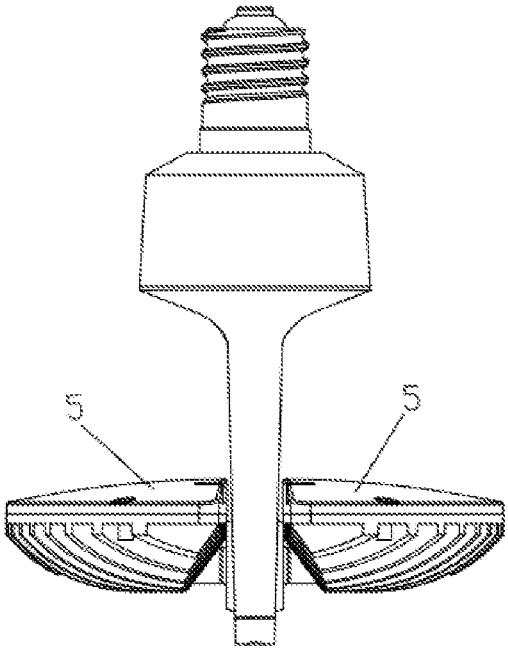
FIG. 16 is similar to FIG. 10, but shown light emitted toward the one-side right above direction.

Referring to FIG. 16, the figure shows light emitted toward the one-side right above direction.

Figure 17:
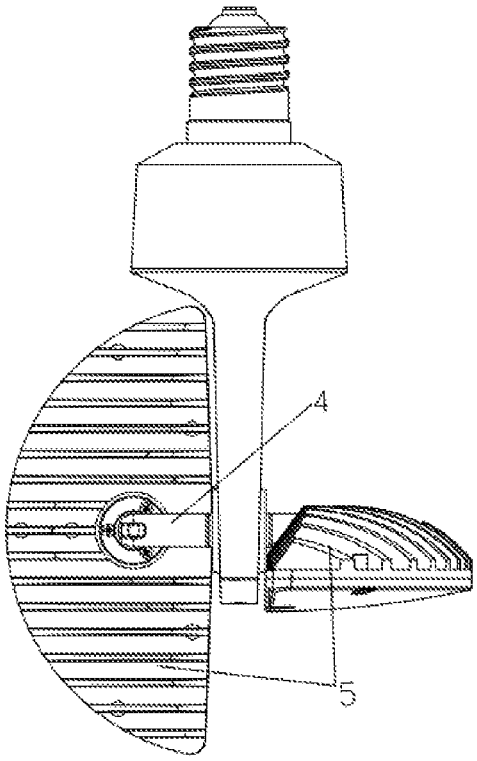
FIG. 17 is similar to FIG. 10, but shown light emitted toward the left one-side right under and right one-side downward direction.

Referring to FIG. 17, the figure shows light emitted toward left one-side right under and right one-side downward directions.

The structure of the present disclosure can flexibly adjust its luminous angle of the lamp, so as to meet the need for emitting light towards a plurality of angles such as downward, obliquely downward, left and right, front and rear, obliquely upward, one-sided and upward, thereby it can be conveniently used in different lamp-housings, and a same lamp can be used in different lighting applications to achieve one purpose of a lamp multipurpose.

Figure 18:
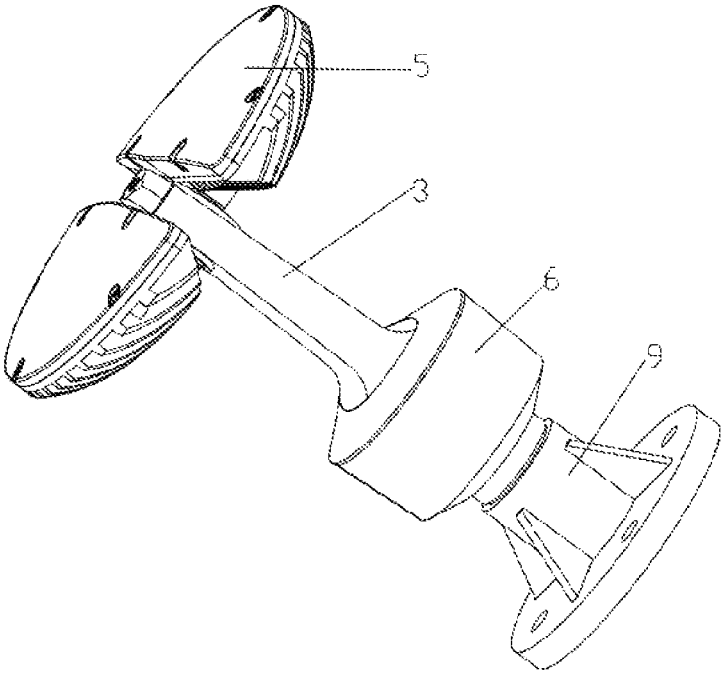
FIG. 18 is a schematic view of the multi-angle light source device in accordance with another exemplary embodiment.

Referring to FIG. 18, alternatively, based on the above description, the multi-angle light source device of the present disclosure according to another exemplary embodiment can also include an installing base 9 for receiving the holder 1 therein to increase the installation modes and expand different lighting applications.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A multi-angle light source device comprising:

a holder;

a housing;

a power supply received in the housing and electrically connected to the holder; and a body fixedly connected to the housing, the body comprising a fixing portion fixedly connected to a proximal portion relative to a central axis of the multi-angle light source of a connecting portion, wherein the connecting portion and at least one illuminant formed on a distal portion of the connecting portion are configured to rotate relative to the fixing portion about a first axis, wherein the distal portion of the connecting portion is mounted centrally relative to a back face of the at least one illuminant, about which mount the at least one illuminant is configured to rotate about a second axis that is orthogonal to the first axis, wherein the fixing portion comprises a pair of holding portions formed on two opposite sides thereof for providing a rotational space for the at least one illuminant.

2. The multi-angle light source device as claimed in claim 1, wherein the holder is movably connected with the housing and rotated relative to the housing.

3. The multi-angle light source device as claimed in claim 1, wherein the fixing portion further comprises an internal, hollow connecting end, an inserting end inserted into the connecting end, and a cover fixedly connected to the connecting end to cover on an end portion of the connecting end distant (remotely located) from the inserting end.

4. The multi-angle light source device as claimed in claim 3, wherein the cover comprises an expansion control interface electrically connected to the power supply for connecting external control signals of its lamp to externally supply power.

5. The multi-angle light source device as claimed in claim 3, wherein the connecting portion comprises a sleeve and an internal, hollow axis sleeved on the sleeve and rotated relative to the sleeve.

6. The multi-angle light source device as claimed in claim 5, wherein the connecting end comprises a fixing groove, and the axis comprises a fixing member formed on its distal end for engaging with the fixing groove.

7. The multi-angle light source device as claimed in claim 5, wherein the connecting portion further comprises an installing portion comprising a rotating member rotated around it and fixedly connected to the illuminant.

8. The multi-angle light source device as claimed in claim 2, wherein the housing comprises a sealing plate, a first block arranged on the inner wall of the housing, and a spring perpendicularly fixed with the sealing plate and comprising a rib protruding outward from the outer wall of the spring; and the holder comprises a second block and an internal gear formed inside the holder, the spring plate inserted into the holder so that the rib is embedded in the internal gear, and the holder is stopped rotating relative to the housing when the second block is resisted against the first block.

9. The multi-angle light source device as claimed in claim 1, wherein the multiangle light source device further comprises an installing base for receiving the holder therein.

10. The multi-angle light source device as claimed in claim 1, wherein the illuminant comprises a lamp plate with a plurality of LEDs arranged thereon in a matrix, a lampshade, and a plurality of cooling fins arranged on the back of the illuminant for heat dissipation of the lamp plate.

11. The multi-angle light source device as claimed in claim 2, wherein the multiangle light source device further comprises an installing base for receiving the holder therein.

* * * * *